United States Patent [19]

Kanamaru et al.

[11] 4,325,678

[45] Apr. 20, 1982

[54] HYDRAULIC PRESSURE PRODUCING SYSTEM FOR A HYDRAULIC PRESS

[75] Inventors: Hisanobu Kanamaru, Katsuta; Moisei Okabe, Tokyo; Akira Tohkairin, Katsuta; Hideo Tatsumi, Mito; Takuzo Kurosawa, Hitachi, all of Japan

[73] Assignees: Hitachi, Ltd.; Kawamura Co., Ltd., both of Tokyo, Japan

[21] Appl. No.: 102,844

[22] Filed: Dec. 12, 1979

[51] Int. Cl.[3] ..... F04B 21/00

[52] U.S. Cl. ..... 417/313; 415/122 R; 417/319; 417/362; 417/424; 417/429

[58] Field of Search ..... 417/313, 319, 424, 223, 417/362, 426–429; 415/122 R, 123, 501

[56] References Cited

U.S. PATENT DOCUMENTS

| | | | |
|---|---|---|---|
| 2,518,725 | 8/1950 | Sauer et al. | 417/319 |
| 2,650,537 | 9/1953 | Rosse | 417/319 X |
| 2,936,774 | 5/1960 | Holley et al. | 417/319 |
| 3,951,570 | 4/1976 | DeBiaggi | 417/319 |
| 4,084,924 | 4/1978 | Ivanoff et al. | 417/424 |
| 4,095,922 | 6/1978 | Farr | 417/319 X |

*Primary Examiner*—Carlton R. Croyle
*Assistant Examiner*—Edward Look
*Attorney, Agent, or Firm*—Craig and Antonelli

[57] ABSTRACT

A hydraulic pressure producing system including clutch means located between an output shaft of a motor and a rotary pump arranged in a liquid and operated from outside. The rotary pump is driven only when the clutch means is engaged to obtain a discharge pressure.

4 Claims, 12 Drawing Figures

HYDRAULIC PRESSURE PRODUCING SYSTEM FOR A HYDRAULIC PRESS

BACKGROUND OF THE INVENTION (1) Field of the Invention

This invention relates to hydraulic pressure producing systems and more particularly to a hydraulic pressure producing system suitable for driving a press and the like.

(2) Description of the Prior Art

A hydraulic pressure producing system for a press generally operates such that the pump is directly driven by the motor as the latter rotates, to drive the press or other load (the piston of a hydraulic cylinder, to be exact) by the discharge pressure of the pump.

The hydraulic pressure producing system of the type described includes two types: one type has an oil tank located separately from the pump for supplying liquid in circulation flow through a line to the pump to obtain the discharge pressure of the pump, and the other type has the pump itself immersed in the liquid and driven while being submerged in the liquid so that the discharge pressure of the pump can be taken out to outside. Of these two types, the latter has in recent years come to attract attention because the system of this type is simple in construction, compact in size and light in weight. However, some disadvantages are associated with these two types of hydraulic pressure producing system of the prior art. That is, as described in Japanese Pat. No. 44881/73, they operate at a high energy consumption level because the pump rotates at all times regardless of whether the pump is at load or no load, noises are produced at all times because the pump rotates at all times, and a large amount of heat is generated by the rotating pump. The noises produced by the pump can be somewhat reduced in the system of the latter type in which the pump itself is submerged in the liquid, but it is impossible to avoid noise production entirely when the pump is at no load. However, since the pump is responsible for the majority of noises produced by the hydraulic pressure producing system, no satisfactory noise characteristics could be produced by using this type alone. For example, let us observe noises produced by internal-gear pumps of the former type of varying capacities or pumps of 64 cc/rev.[I], 100 cc/rev.[II] and 125 cc/rev.[III]. As shown in FIG. 9, when the rpm (N) of the pumps is 1500, the noises produced by the pump [III] of the highest capacity reach a very high level or over 80 phon if the discharge pressure exceeds 200 $kg/cm^2$. When a press or other load is connected to the hydraulic pressure producing system, unnecessarily large noises would be produced during the time the press is driven which accounts for about 50% of the total press operation time. Also, it will be seen from FIG. 8 that no-load time zone B exists at all times between the loaded time zones A (in which the press is driven) so that not only the noises but also a loss of energy is high in level.

From the point of view of performing the operation in safety, the hydraulic pressure producing system of the prior art has disadvantages. For example, almost all the presses are controlled by a hydraulic valve in their operation. When the control valve for controlling the discharge pressure of the pump fails, it is impossible to render the pump inoperative unless the motor is disconnected from the power source. Thus the hydraulic pressure producing system of the prior art does not lend itself to quick starting and quick shut-down. Since difficulties are encountered in rendering the pump inoperative quickly when trouble arises, the hydraulic pressure producing system of the prior art has been unable to operate with assured safety.

SUMMARY OF THE INVENTION

The present invention has its object the provision of a hydraulic pressure producing system of low noise production level and high reliability in performance.

According to the invention, there is provided a hydraulic pressure producing system comprising a motor, a rotary pump submerged in a liquid for producing hydraulic pressure driven by the motor as the latter rotates for producing discharge pressure, clutch means connecting and disconnecting the rotary pump to the motor as desired, and a flywheel interposed between the clutch means and the motor for avoiding fluctuations in the energy of rotation and the torque of the motor.

In the hydraulic pressure producing system, the pump is located perpendicular to the liquid level of the liquid tank, and the rotary shaft of the pump, the rotary shaft of the clutch and the output shaft of the motor are arranged coaxially in a straight line; and the motor rotates at all times while the pump is driven only when the clutch is engaged (when operating at load).

DESCRIPTION OF THE PREFERRED EMBODIMENTS

Figure 1:
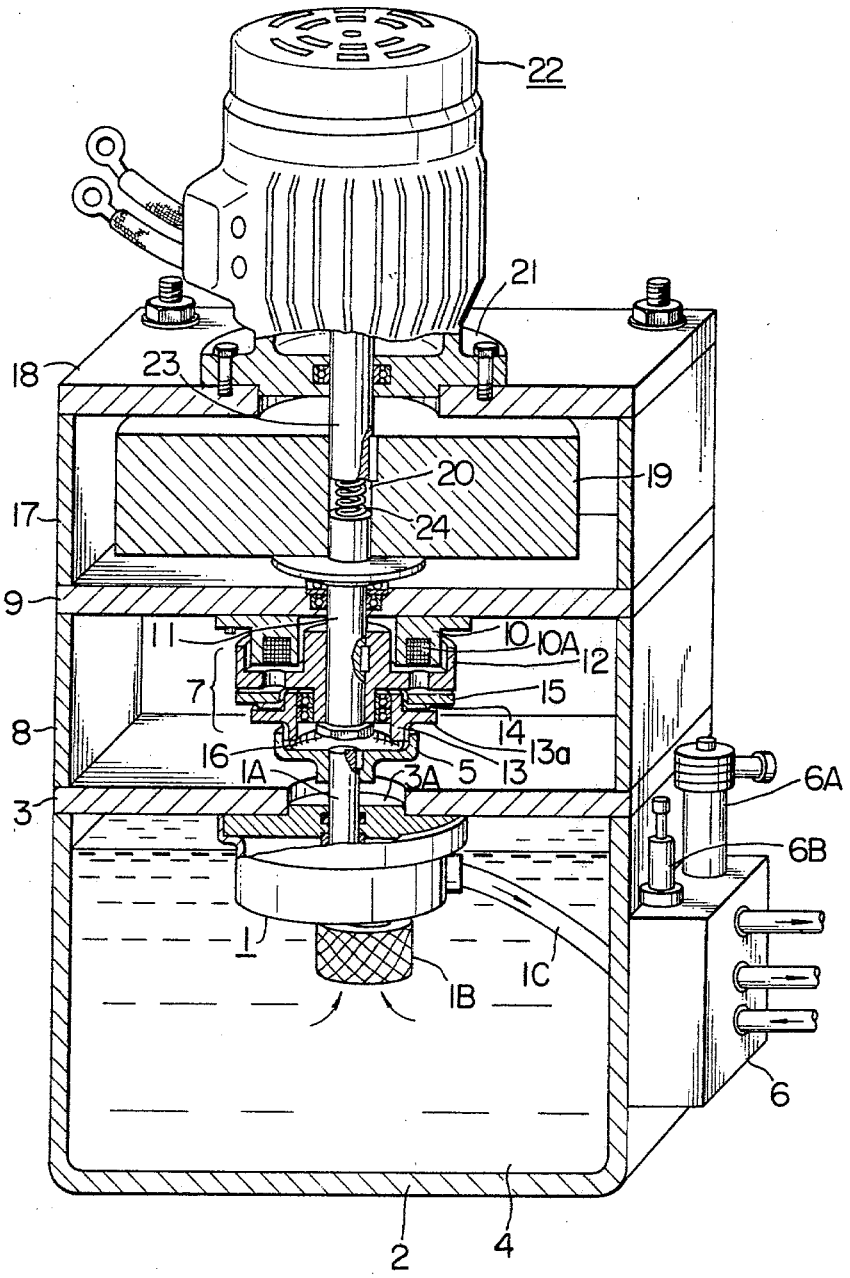
FIG. 1 is a schematic view, with the essential portions being shown in section, of the hydraulic pressure producing system comprising one embodiment of the invention.

FIG. 1 shows one embodiment of the whole of the hydraulic pressure producing system according to the invention, in which a rotary pump 1 which may be in the form of an internal-gear pump is bolted to the central portion of the undersurface of a first partition wall 3 covering the upper surface of a liquid tank 2 and submerged almost entirely in a liquid 4 within the liquid tank 2. The rotary pump 1 has a rotary shaft 1A extending upwardly through a center opening 3A formed in the partition wall 3 and having a coupling 5 secured to its forward end. The rotary pump 1 arranged perpendicular to the liquid level in the liquid tank 2 is constructed such that is sucks the liquid through a liquid filter 1B and discharges same through an outlet conduit 1C into a manifold 6 secured to the outer surface of a side wall of the liquid tank 2. The manifold 6, which is of usual construction, comprises control valves 6A and 6B for distributing hydraulic pressure to a press or other load in a controlled manner.

An electromagnetic clutch device 7 connected to the coupling 5 is covered at its periphery by a first side wall 8 and at its top by a second partition wall 9 and comprises an annular exciting iron core 10 having an annular widing 10A wound thereon, a rotary shaft 11 supported to extend through the iron core 10 and the second partition wall 9, a discal clutch plate 12 secured to the rotary shaft 11 and disposed in slightly spaced juxtaposed relation to the exciting iron core 10, a hub 13 formed with a flange 13*a* at the outer periphery of a lower cylindrical portion of the clutch plate 12 for free rotation through a bearing, and a disk 15 connected to the upper surface of the flange 13*a* of the hub 13 through a plate spring 14 and disposed in spaced juxtaposed relation to the undersurface of the discal clutch plate 12. The hub 13 is in engagement with the coupling 5 through connecting grooves 16 in the form of straight splines. The exciting iron core 10 is bolted to the undersurface of the second partition wall 9.

Connected to the forward end of the clutch rotary shaft 11 is a flywheel 19 formed of iron and covered at its periphery with a second side wall 17 and a lid 18. Formed in the central portion of the flywheel 19 is an opening 20 through which the clutch rotary shaft 11 extends upwardly from below and a rotary shaft 23 of a motor 22 arranged vertically through a flange 21 on the upper surface of the lid 18 extends downwardly from above. A coil spring 24 is placed on the upper end surface of rotary shaft 11 which extends into opening 20 formed within flywheel 19. The spring 24 has particular utility during installation of the motor 22 or lid 18 in that coil spring 24 engages the end of rotary shaft 23 of motor 22 when it is inserted into flywheel opening 20. Thus, further insertion of the shaft 23 and lowering of the motor 22 occurs in opposition to the force exerted by spring 24, so that impact shock produced by engagement of the motor flange 21 against lid 18 is minimized.

In operation, actuation of the motor 22 rotates at the same velocity the flywheel 19 and the discal clutch plate 12 of the electromagnetic clutch device 7. In this condition, the operation is at no load so that no noise is produced. However, when a drive switch, not shown, for the electromagnetic clutch device 7 is turned on, a current is passed to the annular winding 10A to magnetize the exciting iron core 10. This causes the disk 15 that has been stationary to be attracted to the discal clutch plate 12 against the biasing force of the plate spring 14, so that the disk 15 begins to rotate. Since the disk 15 is connected to the hub 13 through the plate spring 14, the hub 13 also rotates and its rotary force is transmitted through the coupling 5 to the rotary shaft 1A of the rotary pump 1, to drive the rotary pump 1.

Figure 7:
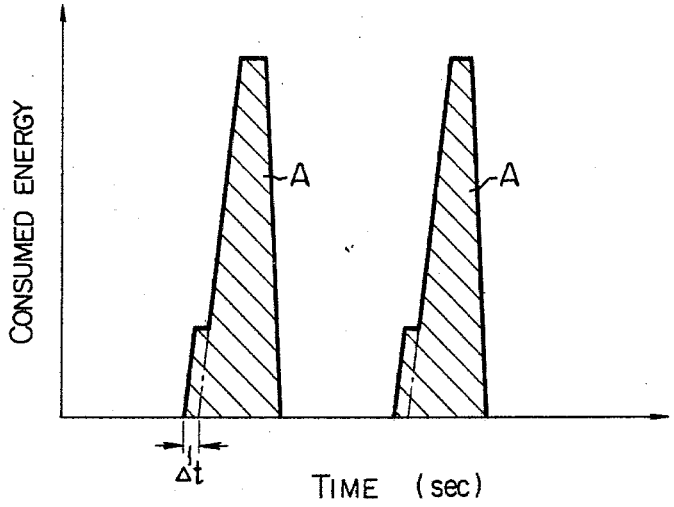
FIG. 7 is a graph showing the energy consumption characteristics of the pump according to the invention obtained when the pump is being driven.
Figure 8:
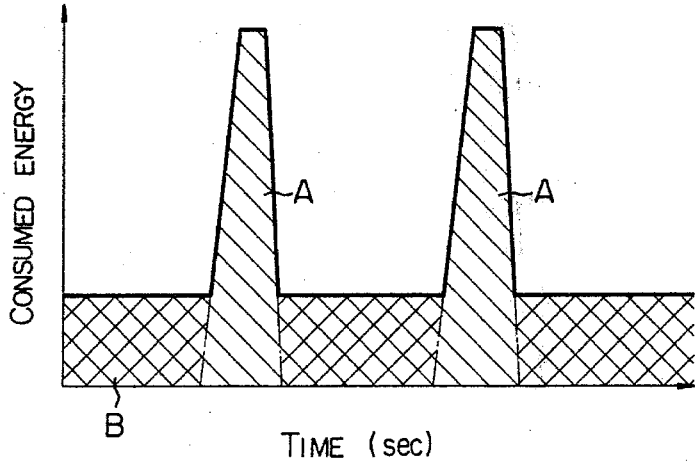
FIG. 8 is a graph showing the energy consumption characteristics of a pump of the prior art obtained when the pump is being driven.
Figure 9:
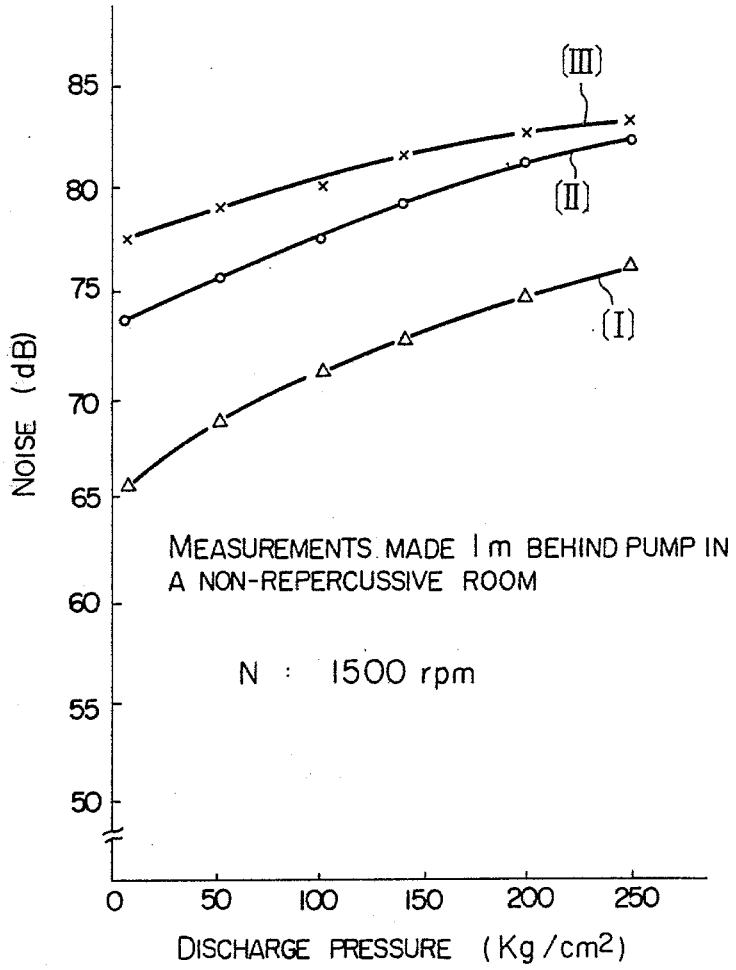
FIG. 9 is a graph showing the noise characteristics of an internal-gear pump for a press of the prior art.

Rotation of the rotary pump 1 results in the liquid in the liquid tank 2 being sucked through the filter 1B and supplied to the manifold 6 through the outlet conduit 1C, to thereby drive a load, such as the hydraulic cylinder of a press. The hydraulic pressure producing system is constructed such that the liquid is returned, after driving the load, to the liquid tank 2 either directly or through the manifold 6 so that the liquid flows in circulation. It is necessary to control the discharge pressure of the pump 1 and its direction depending on the size and construction of the load. The end can be attained by means of the control valves 6A and 6B. When the electromagnetic clutch device 7 is de-energized, the disk 15 is released from engagement with the discal clutch plate 12 and returns to its original position by virtue of the biasing force of the plate spring 14 so that the rotary pump 1 is disconnected from the motor 22. This condition will be explained by referring to FIG. 7. When the sysem operates or the motor 22 is actuated for performing no operation (at no load), the clutch device 7 is disengaged and consequently the rotary pump 1 consumes no energy (corresponding to B in FIG. 8). Therefore, when the rotary pump 1 is driven, there is no energy consumption except for a slip loss $\Delta t$ (about 0.1 second). Noisewise, the hydraulic pressure producing system can be said to be satisfactory because no noise is produced at no load or when the rotary pump 1 is not driven.

The relation between the motor 22 which is the drive source of the rotary pump 1 and the flywheel 19 and rotary pump 1 will be discussed.

Figure 2:
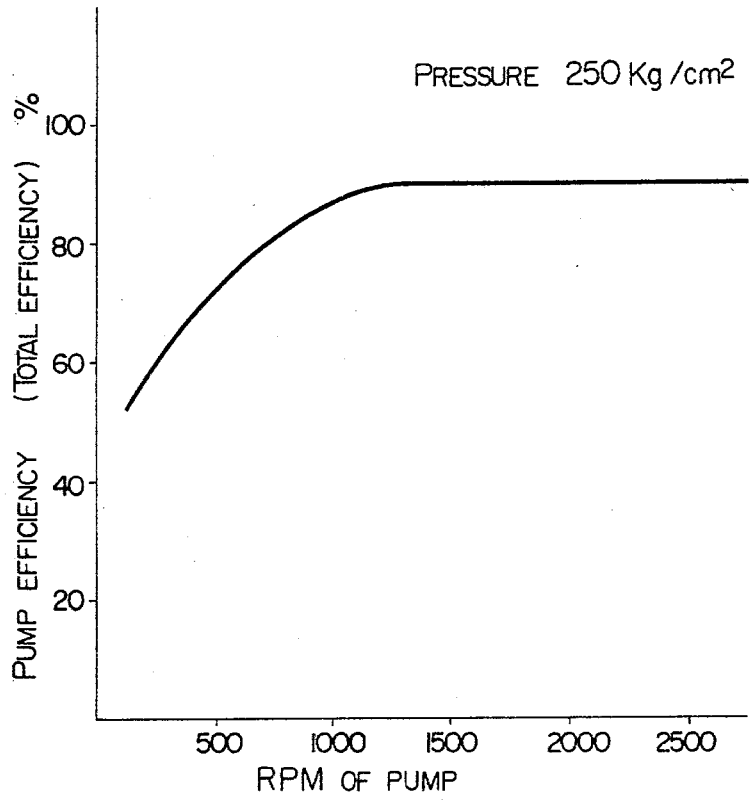
FIG. 2 is a diagrammatic representation of the efficiency characteristics of the pump according to the invention.

Generally, an internal-gear pump has a characteristic such that, as shown in FIG. 2, its efficiency is improved as the rpm thereof is increased. For example, a pump of a pressure of 250 kg/cm$^2$ becomes substantially constant in performance when its rpm is over 1000. Therefore, it is essential to design and construct a pump of high efficiency by taking advantage of this characteristic.

Figure 3:
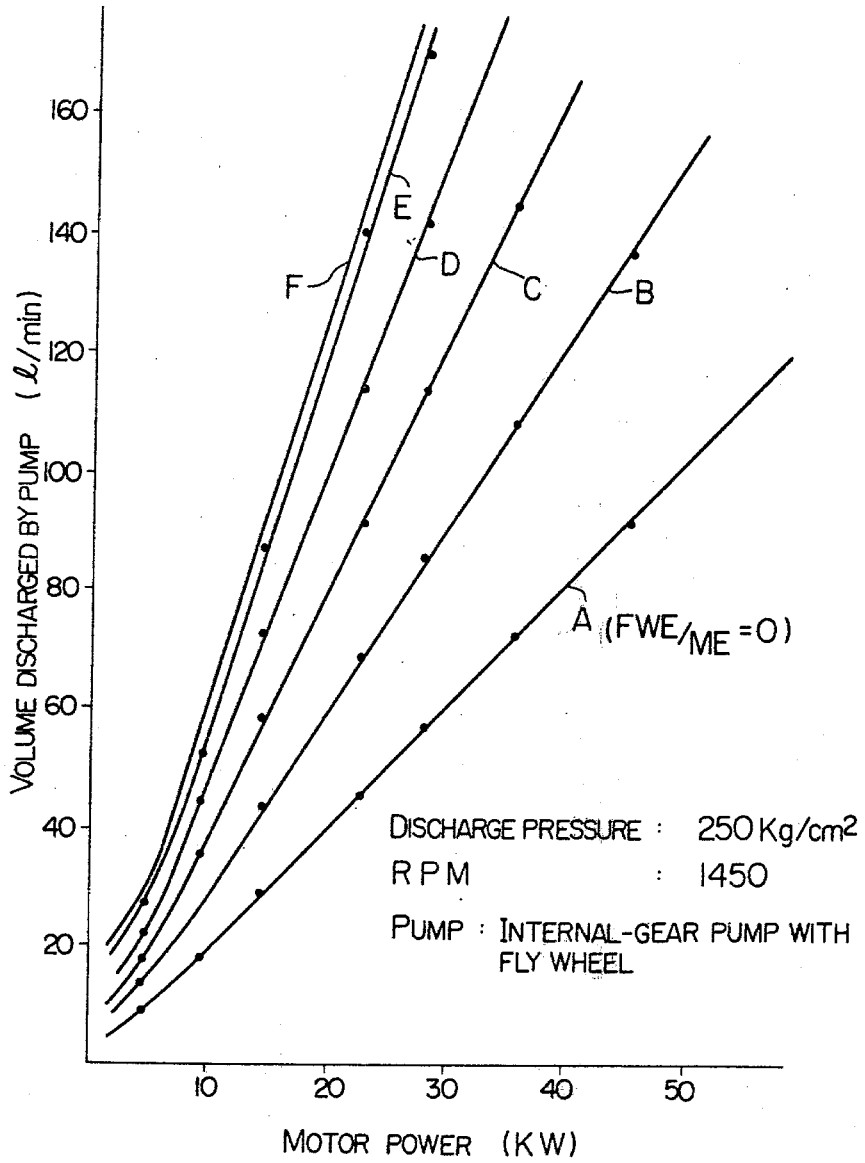
FIGS. 3 and 4 are graphs showing the characteristics of changes in the energy of the flywheel with respect to changes in the energy of the motor according to the invention.

The energy of the motor 22 and flywheel 19 will be discussed. When a pump of a discharge pressure of 250 kg/cm$^2$ is driven, the ratio of the flywheel energy (FWE) to the motor energy (ME) can be successively increased as shown in A–F in FIG. 3, from 0 to 20 through 4, 8, 12 and 16. However, substantially no change is shown when the ratio is from 16 to 20 (E–F). Conversely, when the ratio is over 20, the load applied to the motor shows a tendency to increase, with a result that seizure of the motor or other undesirable phenomenon occurs. It will thus be understood that if the ratio FWE/ME is in the range between 8 and 20, it is possible to enable the pump to discharge a volume which can be put to practical use even if the power of the motor is minimized. This does not merely mean that a motor of a lower capacity is desirable, and the relation between the capacity of the pump and the capacity of the motor should be taken into consideration as subsequently to be described, before any valid conclusion can be reached.

Figure 4:
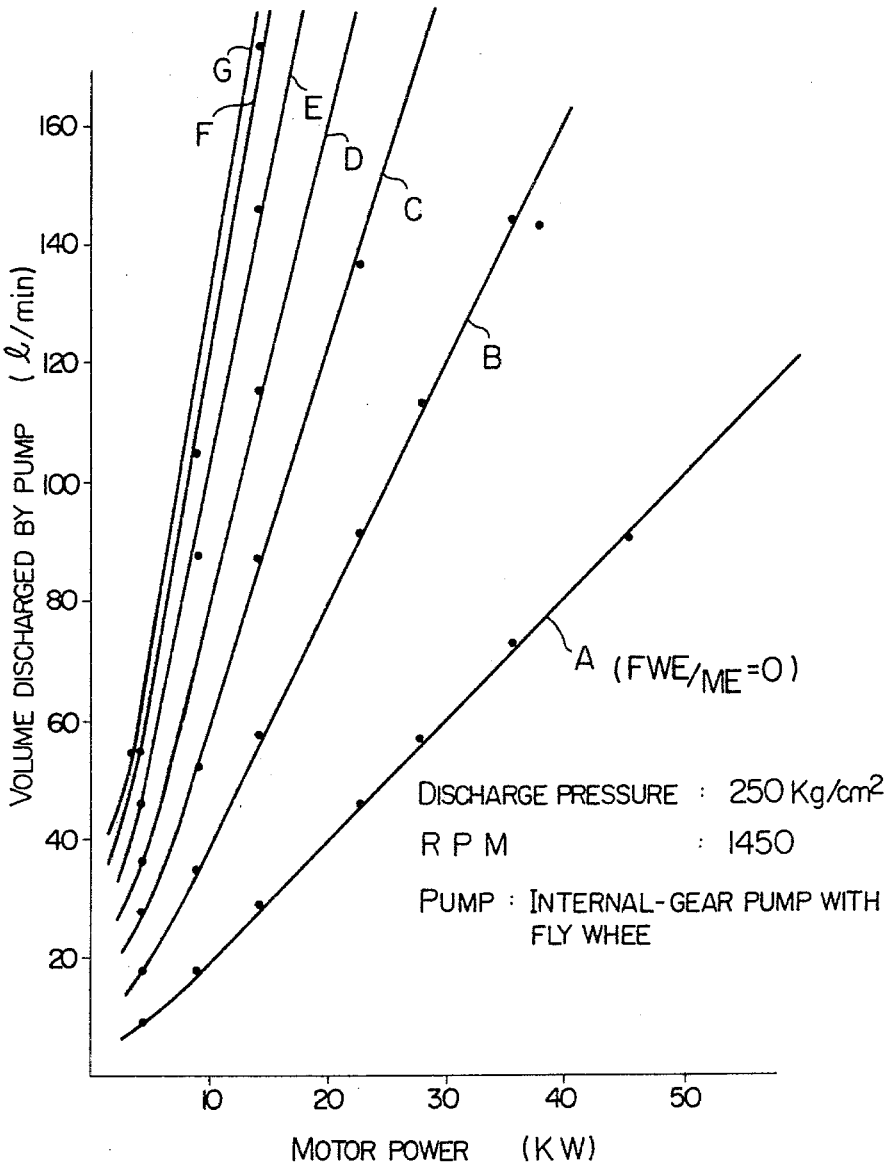

The characteristics of the system provided with a flywheel and a clutch are shown in FIG. 4, for information. In this system, the energy consumed by the pump can be stored in the flywheel because the pump is driven only when the clutch is engaged as desired. Moreover, it is possible to increase the volume discharged by the hydraulic pressure producing system by reducing the size of the motor.

Figure 5:
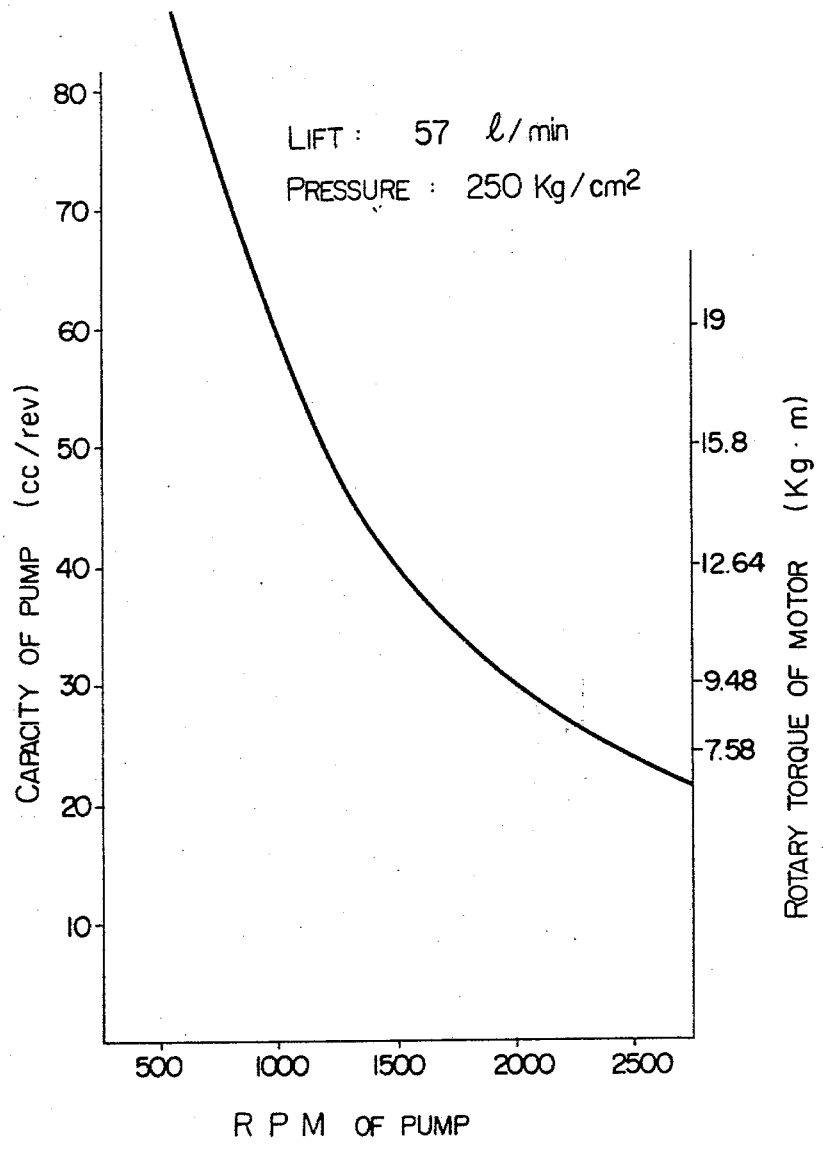
FIG. 5 is a graph showing the characteristics of the capacity of the motor according to the invention with respect to its rpm.

With regard to the relation between the capacity of a pump to the rpm thereof, it is widely known that, as shown in FIG. 5, the capacity can be reduced if the rpm is increased. In the system according to the invention, the specifications are such that the motor 22 is of 11 KW, the flywheel energy is about twelve (12) times as great as the motor energy, and the rotary pump 1 has a pressure of 57 l/min. and 250 kg/cm$^2$ and its rpm is 2450. It will be seen that the system is compact in size and operates at high speed. Since the system operates at high speed, inertia is low when the pump is driven, making it possible to obtain a compact size in a clutch device.

In the embodiment of the invention shown and described hereinabove, consumption of energy at no load is low and the pump produces no noise during operation at no load as compared with a hydraulic pressure producing system of the prior art wherein the pump is driven at all times regardless of whether or not a load is applied. Thus the average noise level of the system can be reduced to about one half that of a prior art system. Thus the system according to the invention enables environmental description by noises to be eliminated and permits generation of heat by the motor to be avoided as much as possible without requiring any special cooling device. The use of the clutch device enables the rotary pump to be disconnected from the motor readily and quickly, so that the system is highly reliable in performance because it has a dual safety mechanism (control valves in the hydraulic pressure supply circuit and clutch). The presence of the flywheel between the motor and the clutch device enables fluctuations in the energy of rotation and the torque of the motor which might otherwise occur when the rotary pump is connected to the motor to be minimized, so that the system can be smoothly connected to a load and can have a constant discharge pressure. In addition, the pump itself is arranged perpendicularly to the liquid level in the liquid tank, and this eliminates the need to use a seal to prevent a leak of the liquid which is necessary when the pump is located horizontally.

Figure 6:
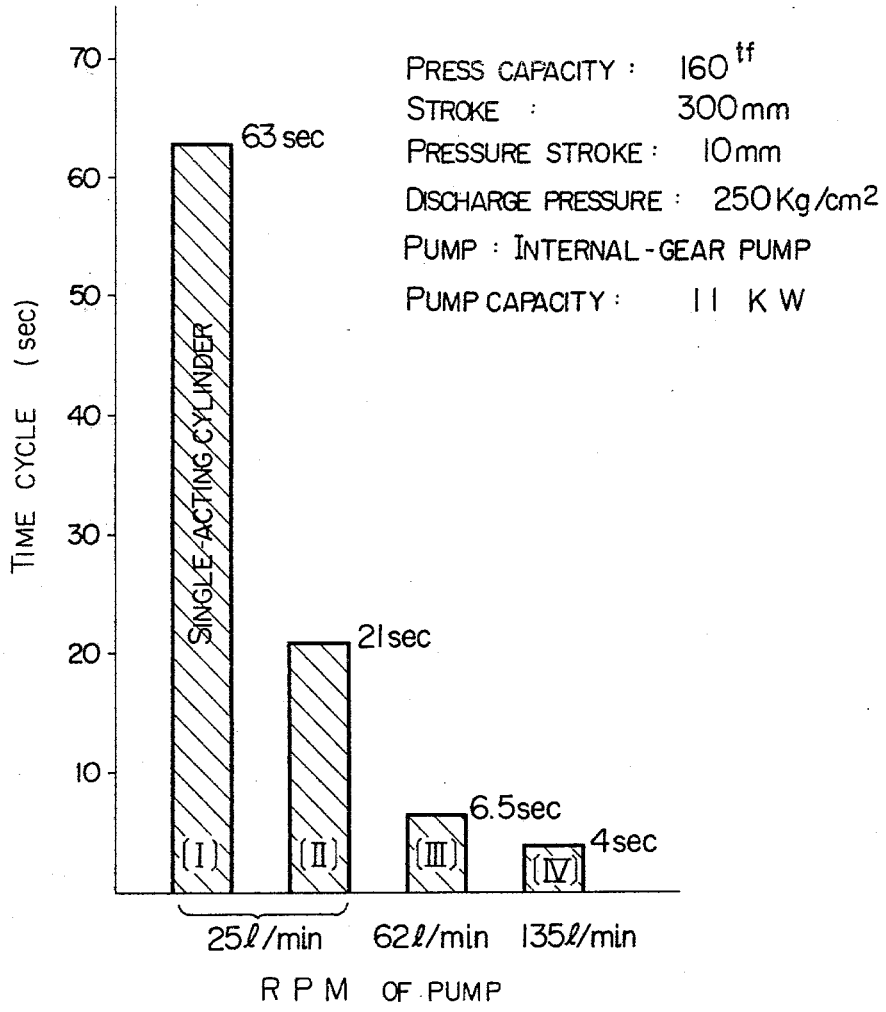
FIG. 6 is a view showing the performance of the pump according to the invention represented by the cycle time with respect to the volume discharged by the pump.

The relation between the volume discharged by the pump and the cycle time of the cylinder when the present invention is applied to a press will now be described. In the prior art, operation efficiency is relatively low as shown in FIG. 6 which shows that when the volume discharged by the pump is 25 l/min., a common single-acting cylinder [I] requires 63 seconds and a cylinder with a booster [II] requires 21 seconds. However, when a flywheel is mounted on the output shaft of the motor and the cylinder of the press has a booster [III], the volume discharged by the motor increases to 62 l/min. and the cycle time is reduced to 6.5 seconds. When a clutch is added [IV], a marked increase in operation efficiency is shown by the corresponding values of 135 l/min. and 4 seconds.

Figure 10:
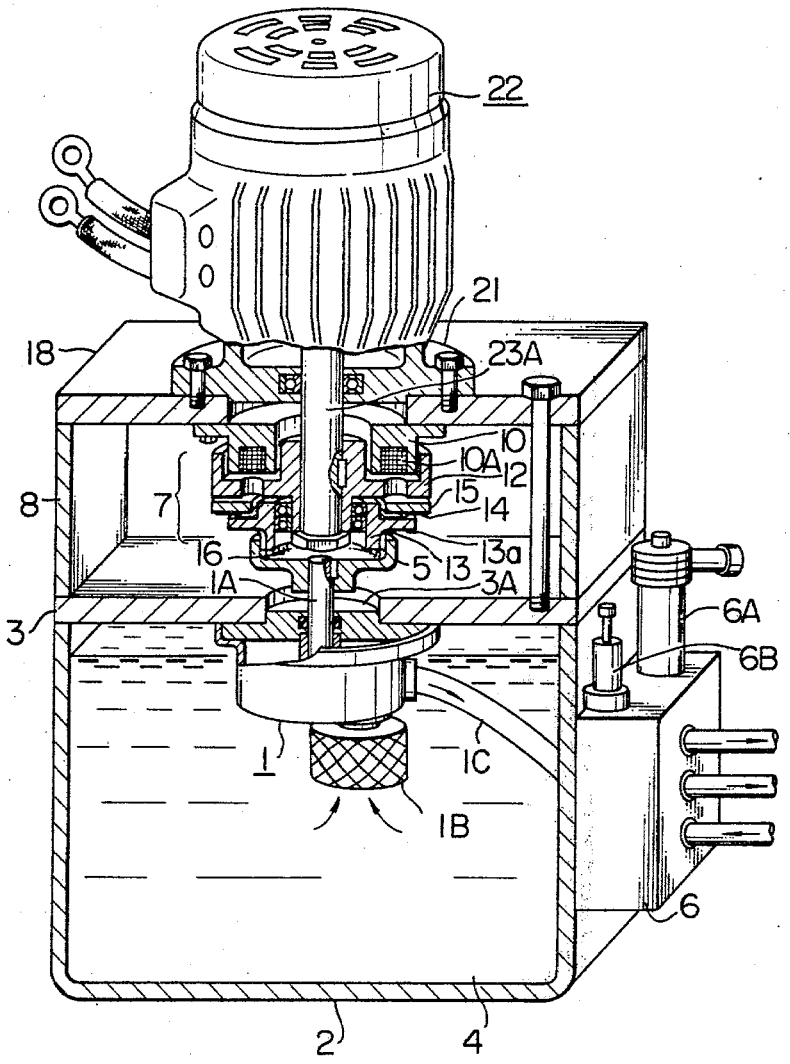
FIG. 10 is a schematic view, with the essential portions being shown in section, of the hydraulic pressure producing system comprising another embodiment of the invention.

FIG. 10 shows another embodiment of the invention which is similar in basic construction to the embodiment shown in FIG. 1 except that some modifications are made to cope with noise production and increase safety. More specifically, in this embodiment, the flywheel is dispensed with to minimize fluctuations in the energy of rotation and the torque of the motor, and the rotary shaft 11 of the clutch device 7 and the rotary shaft 23 of the motor 22 are combined into a common rotary shaft 23A. This embodiment has particular utility in driving a load which can tolerate a certain degree of fluctuations in the discharge pressure of the pump and provides a hydraulic pressure producing system of compact size and low noise level.

Figure 11:
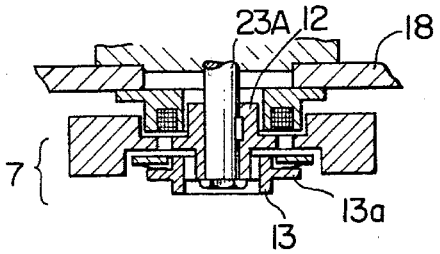
FIG. 11 is a sectional view of the clutch section of the hydraulic pressure producing system comprising still another embodiment of the invention.

In the embodiment shown in FIG. 1, it is not essential that the flywheel 19 be located in the upper portion of the clutch device 7. When the hydraulic pressure producing system is of a relatively low capacity, the flywheel 19 may be secured in place on the outer periphery of the discal clutch plate 12 by connecting them unitarily or fitting the former over the latter, as shown in FIG. 11. The hydraulic pressure producing system of this modification has the advantage of being small in axial length.

Figure 12:
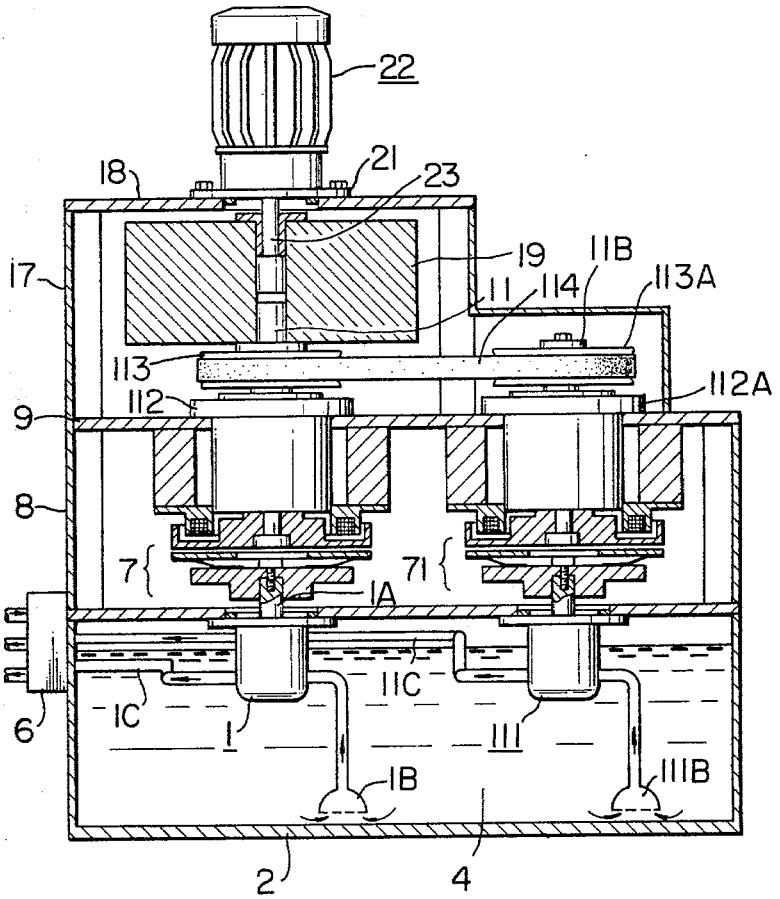
FIG. 12 shows a further embodiment of the invention in which two rotary pumps are arranged parallel to each other for producing hydraulic pressure.

FIG. 12 shows still another embodiment whose feature is that two rotary pumps are driven by a single motor and they are controlled separately and independently. More specifically, a pulley 113 is secured to the rotary shaft 11 between the clutch device 7 supported by a thrust bearing 112 and the flywheel 19, and a belt 114 is trained over the pulley 113 and another pulley 113A secured to another rotary shaft 11B for driving another rotary pump 111 located in side-by-side relation to the rotary pump 22. Depending on the operating condition of the motor 22, the clutch devices 7 and 71 may be engaged either singly or both at the same time to operate one of or both of the pumps 1 and 111 at the same time. Thus the hydraulic pressure producing system provided has a wide range of applications for the operation thereof can be controlled in a multiplicity of ways. In this system, one of the pumps may be lower in capacity than the other, and any combination of the pumps can be made as desired to serve the purpose and suit the condition.

What is claimed is:

1. A hydraulic pressure producing system for a hydraulic press comprising:

a rotary pump for producing hydraulic pressure having a suction port opening in a liquid within a liquid tank, and a rotary shaft arranged to rotate about an axis perpendicular to the liquid level in the liquid tank;

first support means having said rotary pump secured thereto in a manner to allow said rotary shaft to extend upwardly therethrough;

a clutch rotary shaft journaled for rotation about the same axis as the pump rotary shaft by second support means secured in place in spaced-apart relation to said first support means;

clutch means interposed between said clutch rotary shaft and said rotary shaft of said rotary pump and operative to be engaged and disengaged electromagnetically;

a motor secured in upright position to upper support means located in spaced-apart relation to said second support means, said motor having an output shaft that is rotatable about said axis; and a flywheel mounted between said output shaft of said motor and said clutch rotary shaft.

2. A hydraulic pressure producing system as claimed in claim 1, wherein said flywheel is formed with an opening into which said clutch rotary shaft and said output shaft of said motor extend and are connected with the flywheel.

3. A hydraulic pressure producing system as claimed in claim 2, wherein a shock-absorbng resilient means is located in the opening formed in said flywheel for engaging the output shaft therein so as to minimize shock occurring during mounting of the motor to said upper support means.

4. A hydraulic pressure producing system as claimed in claim 3, wherein said rotary pump and said clutch means are connected together through a coupling secured to a forward end of the rotary pump, and a rotary boss supported for rotation by said clutch rotary shaft, said coupling and said rotary boss being interconnected through a straight spline.

* * * * *